US009440779B1

(12) United States Patent
Hach et al.

(10) Patent No.: US 9,440,779 B1
(45) Date of Patent: Sep. 13, 2016

(54) COMPARTMENT POUCH FOR WIPES AND LIQUID

(71) Applicant: MONDI JACKSON, INC., Jackson, MO (US)

(72) Inventors: Maik Hach, St. Louis, MO (US); Markus Hoedebeck, Cape Girardeau, MO (US); Mark Gum, Cape Girardeau, MO (US)

(73) Assignee: Mondi Jackson, Inc., Jackson, MO (US)

( * ) Notice: Subject to any disclaimer, the term of this patent is extended or adjusted under 35 U.S.C. 154(b) by 0 days.

(21) Appl. No.: 14/810,724

(22) Filed: Jul. 28, 2015

(51) Int. Cl.
*B65D 81/32* (2006.01)
*B65D 75/52* (2006.01)

(52) U.S. Cl.
CPC ..... *B65D 75/527* (2013.01)

(58) Field of Classification Search
CPC ..... B65D 81/32; B65D 81/3266
USPC ..... 206/229, 219, 222, 494; 383/25
See application file for complete search history.

(56) References Cited

U.S. PATENT DOCUMENTS

| | | | | |
|---|---|---|---|---|
| 5,616,337 | A | 4/1997 | Kasianovitz et al. | |
| 6,062,381 | A | 5/2000 | Paley et al. | |
| 7,357,248 | B2 | 4/2008 | Sivakumar et al. | |
| 2003/0031764 | A1 | 2/2003 | Richards et al. | |
| 2006/0124476 | A1* | 6/2006 | Sivakumar | A47L 13/17 206/207 |
| 2006/0151351 | A1 | 7/2006 | Hughes | |
| 2009/0142006 | A1* | 6/2009 | Wine | B65D 31/12 383/38 |
| 2010/0126893 | A1* | 5/2010 | Sinykin | D04B 1/02 206/361 |

FOREIGN PATENT DOCUMENTS

| | | |
|---|---|---|
| EP | 1201562 | 5/2002 |
| GB | 2506412 | 4/2014 |
| JP | 2007-230622 | 9/2007 |
| WO | WO2008/017939 | 2/2008 |

* cited by examiner

*Primary Examiner* — Steven A. Reynolds
*Assistant Examiner* — King M Chu
(74) *Attorney, Agent, or Firm* — Michael J. Striker

(57) ABSTRACT

A dual compartment pouch for wipes and liquid is formed as a pouch body made of a pouch film. The pouch body has a front wall and a rear wall, side seals which run on at least a portion of a circumferential pouch edge and a parting seal connecting the front wall and the rear wall and separating a first compartment from a second compartment in a fluid-tight manner. A first fitting on the first compartment and a second fitting on the second compartment have a complementary shape to one another. The complementary shapes of the first fitting and the second fitting, after a separation of the compartments along the parting seal, enable fluid communication of the first and the second fittings with one another.

11 Claims, 3 Drawing Sheets

COMPARTMENT POUCH FOR WIPES AND LIQUID

BACKGROUND OF THE INVENTION

The invention relates to a package for wipes, where the wipes are initially held in readiness separately from a separate liquid. Specifically, the invention relates to a dual compartment pouch for wipes and liquid.

In practice, various packages are known in which wipes already impregnated with liquid are held in readiness in a compartment, where such a package is opened at a withdrawal opening. For example, an injection moulded part made of plastic with a flap may be provided as the withdrawal opening. Furthermore, embodiments are known in which a pre-punched closure area is covered by a film, where the film is provided with a permanent adhesive, allowing for re-closure of the closure area. The wipes are provided, without limitation, for example, for cleaning, disinfecting. cosmetic applications or also as moist toilet paper.

In certain applications, it is desirable if the liquid is only subsequently applied to the wipes. Firstly, the advantage is then obtained that the wipes are easily stored, whereas in the case of already moistened wipes, liquid can escape at a prepared withdrawal opening, for example, a perforation. Even if in a simple embodiment of the package, such a withdrawal opening is covered with a separate slip of film, the liquid can attack the adhesive and/or an imprint depending on its composition.

Moreover, intended purposes also are feasible in which only a limited storage is possible after moistening the wipes. This is the case, for example, when the liquid slowly decomposes the wipes or when a chemical reaction takes place when moistening the wipes. For example, it also is feasible that the wipes are wetted with a first liquid which then reacts subsequently with a further liquid.

Furthermore, it also is feasible that in a dual compartment system for the wipes and the liquid, a moistening of the wipes is also accomplished subsequently. Thus, in the case of moist wipes a drying out is frequently observed during fairly long storage, which can be compensated by replenishing liquid. Finally wipes can also be provided for different intended purposes which require a different degree of moistening, which can be taken into account with the separate supply of liquid.

In order to at least partially meet the described requirements, dual compartment pouches are known from EP 1 201 562 B1, U.S. Pat. No. 7,357,248 B2, U.S. Pat. No. 6,062,381 A and U.S. Pat. No. 5,616,337 in which the liquid is initially held in readiness in a separate compartment before a barrier located inside the package between the compartments is broken open before a usage for the first time and the liquid passes directly to the wipes. Alternatively the liquid is initially located in a capsule which is located in a compartment together with the wipes, where the capsule is then broken open for a usage for the first time.

In the known embodiments, there is the disadvantage that an unintentional breaking open of the barrier is not excluded, in which case this is then not indicated to the user. Consequently, there is the risk that the wipes are moistened far before their envisaged usage and then can no longer be used unrestrictedly. Furthermore, the manufacture of a package with an internal breakable barrier also is complex, where a compromise must always be found between the manageability and the security of the barrier against an unintentional opening.

Known from GB 2 506 412 A is a package for wipes and liquid which has a total of three compartments. In the disclosed package, however, the partitions running between the compartments inside the packaging also can be broken so that the previously described disadvantages should be taken into account.

Known from US 2006/0151351 A1 is a dual compartment pouch in which the two compartments are separated from one another by a permanent sealing seal which cannot be broken open. The two compartments are provided to accommodate moist wipes on the one hand and dry wipes on the other hand, with no mixing taking place.

According to JP 2007-230622 A, building products are held in readiness in two separate different-sized containers which each have a screw connection for a spout. A small spout is screwed on the smaller container, which may then be inserted with its tip into the screw connection of the larger container. Doing so achieves a fluid communication between the two different-sized containers held separately in readiness. The substances mixed in the large container are then dispensed through a large spout that can be fastened on the corresponding screw closure. As a result of the many different elements, however, the handling of the system described is in need of improvement, with comparatively large quantities of waste also resulting during use as intended.

SUMMARY OF THE INVENTION

The present invention overcomes the shortcomings of known arts, such as those mentioned above.

To that end, the present invention provides a dual compartment pouch for wipes and liquid in which the wipes are initially separated particularly reliably from the liquid and which is characterized by a particularly simple and flexible manageability.

In an embodiment, the invention provides a dual compartment pouch for wipes and liquid comprising a pouch body made of a pouch film, having a front wall and a rear wall, side seals which run on at least a portion of a circumferential pouch edge and preferably connecting the front wall and the rear wall directly to one another, a parting seal connecting the front wall and the rear wall, which separates a first compartment from a second compartment in a fluid-tight manner and a first fitting on the first compartment and a second fitting on the second compartment. The fittings have a complementary shape to one another which after a separation of the compartments along the parting seal enables a fluid communication, in particular a tight fluid communication, of the fittings with one another.

According to the invention, a dual compartment pouch is provided in which the wipes and the additional liquid are separated from one another by a permanently tight parting seal. A single cohesive uniform package is therefore formed in which the separation is clearly identifiable for the user. An unintentional mixing of the wipes with the liquid by an internal connection in the package is eliminated. On the contrary, the two compartments are separated from one another along the parting seal, for which a weakening line is expediently provided. This weakening line preferably runs centrally or approximately centrally of the parting seal and is formed, for example, by a perforation, a stamping, a laser line or the like. After the separation of the two compartments on the parting seal, the compartments can be handled separately and in particular inserted into one another with the aid of the fittings to produce a fluid communication.

According to the invention, the two fittings have a complementary shape to one another so that a communication is possible without intermediate pieces, adapters or the like.

In principle, the fittings can be arranged at any point of both compartments. A particularly simple arrangement is obtained if the fittings are sealed into respectively one associated section of a side wall.

The complementary shape of the two fittings is achieved in various ways. Preferably the first fitting is a female connecting member with an opening and the second fitting is a male connecting member with a spout that can be inserted into the opening. As a result of a precise matching of the dimensions and/or a slightly conical configuration, it also can be achieved that both fittings are held in a frictional connection on one another by an appropriate effect of force so that during a transfer of liquid between the compartments, an accidental loosening or escape can be avoided.

Expediently, the first compartment contains the wipes, which are either dry or provided with a base liquid, in which case the liquid is then initially held in readiness in the second compartment and after connection of the two compartment via the fittings, is transferred into the first compartment.

Before and after the transfer of the liquid, a tight closure usually needs to be ensured. Frequently it also is desirable that the wipes are initially tightly closed in order to avoid contamination. Against this background, one of the fittings or both fittings is provided with a breakable closure or a removable cover. A possible cover, for example, is a protective cap which can be screwed-on in the case of the male connecting member and screwed-in in the case of the female connecting member. Alternatively, it also is possible that a protective cap is only held by breakable webs, adhesive or the like and thus, after loosening, cannot be replaced again.

In the case of a screw or bayonet closure, however, with regard to the first compartment provided with the wipes, there is the advantage that even after filling, a tight closure can be ensured again. Additionally or alternatively, the first fitting is provided with a type of valve which only allows the ingress of liquid.

After moistening the wipes with the liquid, these are ready for use.

Within the framework of the invention, usually a plurality of wipes are provided in the dual compartment pouch, in particular, in the first compartment. Naturally the invention also covers an embodiment in which only one wipe is contained in the first compartment.

If, however, a plurality of wipes are accommodated by the first compartment, there is also the need to reclose the first compartment after removing a wipe. For this purpose the first compartment has a tear-open or fold-out withdrawal opening on the front wall or the rear wall.

Such a withdrawal opening can, for example, be formed by a separate injection-moulded part which is known, for example, from WO 2008/017939 A1.

According to an embodiment, a separate film slip with permanent adhesive is provided over the withdrawal opening on the front wall or the rear wall. The withdrawal opening is formed, for example, whereby a corresponding section of the pouch film is cut or perforated on the front wall or the rear wall and is then raised with the separate film slip during opening. Alternatively, a simple slit is covered by a film slip. Corresponding embodiments are described in U.S. Pat. No. 5,616,337.

The pouch body of the dual compartment pouch is formed from the pouch film, preferably by heat sealing, where the different fittings are then fastened on the first compartment or the second compartment. It lies within the framework of the invention that the front wall and the rear wall are formed by two separately supplied sections of the pouch film where side seals are then provided around the entire circumferential pouch edge.

According to an embodiment, the pouch film is folded onto itself to form the front wall and the rear wall so that then on one side of the pouch body, the pouch edge is formed by a folding edge. In particular, the folding edge can run parallel to the parting seal.

Both in such an embodiment and also with side seals around the entire pouch edge, the parting seal connects the mutually opposite side seals. In order to facilitate separation, the side seals can then each have a recess at the ends of the parting seal, with the result that when force is introduced by a user, a tearing along a weakening line is made easier.

The pouch film is preferably multi-layer and has a heat-sealable inner layer. In particular, the pouch film can be laminated in a multilayer manner, in which case an internal imprint is then provided. There is then the advantage that before mixing the wipes with the liquid in the first compartment, an imprint or a laminating adhesive cannot be attacked by the liquid even if weakening lines, perforations or the like are provided to form a withdrawal opening.

Within the framework of the invention, the volume of the compartments can be the same or different without restriction. Frequently a smaller volume is required to accommodate the liquid than is required to accommodate the wipes. For this purpose the compartments can have a different width in a direction transverse to the parting seal. As required therefore, the parting seal is then displaced laterally in order to provide suitable volumes for the first compartment and the second compartment for different applications.

The dual compartment pouch according to the invention is produced by folding and heat sealing the pouch film. The fittings are then inserted with a suitable machine which is provided for the simultaneous manufacture of two pouches where different fittings having a complementary shape are supplied and sealed-in for the first compartment and the second compartment. A corresponding machine is operated in a clocked manner, wherein in one operation not two separate pouches, but the dual compartment pouch is formed with the compartments connected by the parting seal.

BRIEF DESCRIPTION OF THE DRAWINGS

Further features and advantages of the invention will become apparent from the description of embodiments that follows, with reference to the attached figures, wherein.

DETAILED DESCRIPTION OF THE PREFERRED EMBODIMENTS

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1:
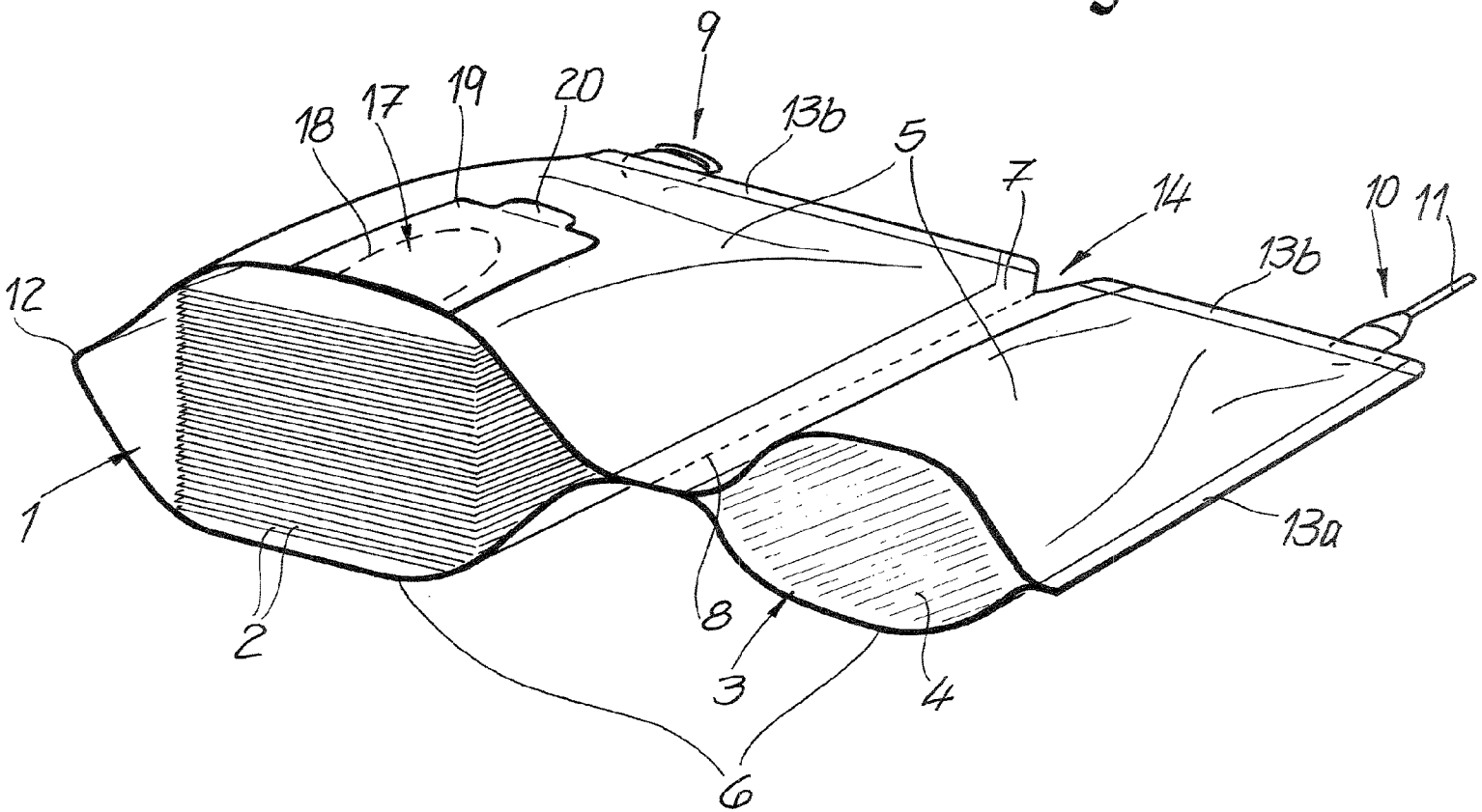
FIG. 1 shows a perspective view of a dual compartment pouch in one section.

FIG. 1 shows a dual compartment pouch in which wipes 2 are accommodated in a first compartment 1 and liquid 4 is accommodated in a second compartment 3.

The pouch body comprising a front wall 5 and a rear wall 6 is formed from a multilayer pouch film, which has a heat-sealable inner layer. Accordingly, the two compartments 1, 3 are permanently separated from one another by a parting seal 7 formed by heat sealing, where the parting seal 7 centrally has a weakening line 8 in the form of a perforation.

The two compartments 1, 3 can be torn apart along the weakening line 8 without the compartments 1, 3 themselves opening. In order to wet the wipes 2 with the liquid 4, the dual compartment pouch has a first fitting 9 on the first compartment 1 and a second fitting 10 on the second compartment 3. The fittings 9, 10 have a complementary shape with respect to one another, which, after separation of the compartments 1, 3 along the parting seal 7, enables a direct tight fluid connection of the fittings 9, 10.

Figure 3:
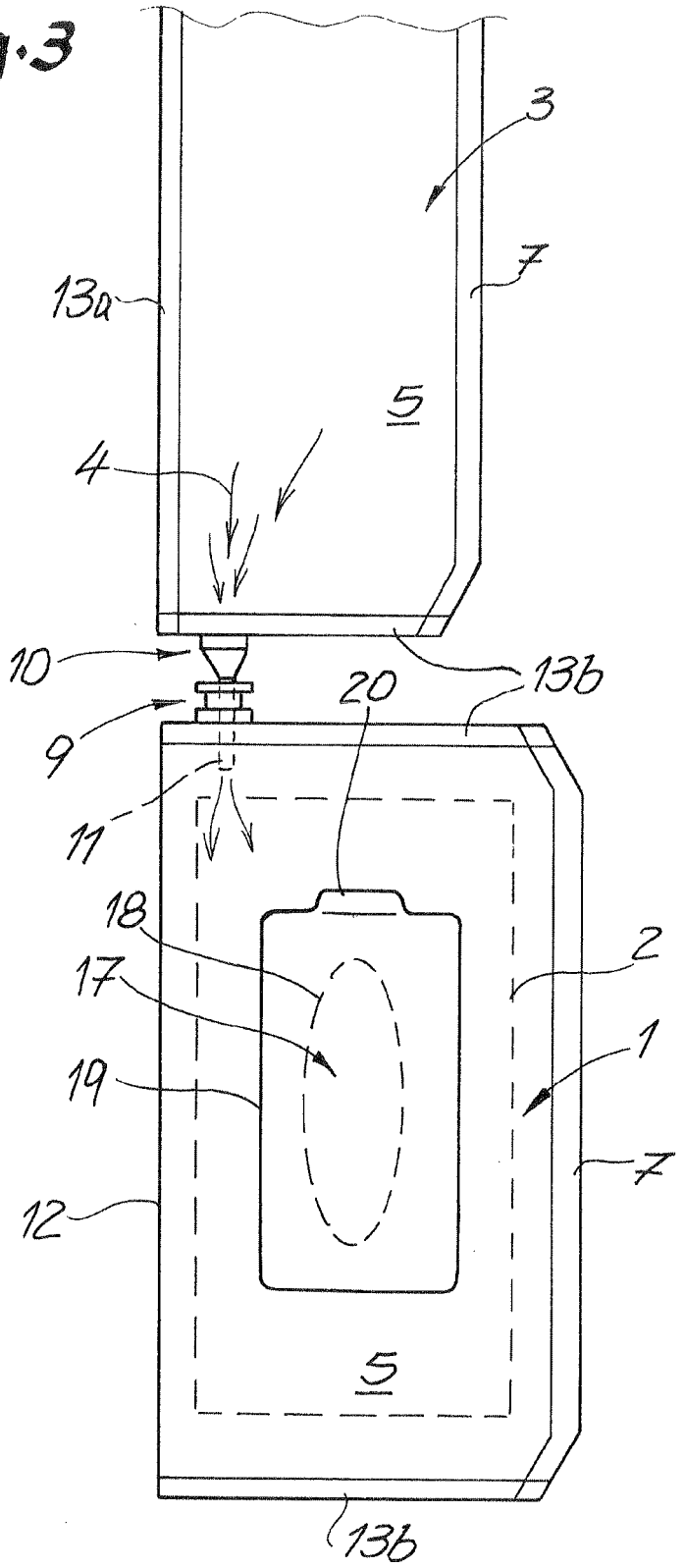
FIG. 3 shows the dual compartment pouch according to FIG. 1 after a separation of the two compartments.

Specifically the first fitting 9 forms a female connecting member with an opening, whilst the second fitting 10 forms a male connecting member with a spout 11 which can be inserted in the opening. As shown in FIG. 3, after a separation of the compartments 1, 3 and a connection of the fittings 9, 10 by means of the spout 11, the liquid 4 can be transferred from the second compartment 3 into the first compartment 1, with the result that the wipes 2 are moistened with the liquid 4.

In the embodiment according to FIG. 1, it can already be seen that at the circumferential pouch edge, a lateral section is formed by a folding edge 12 whereas side seals 13*a*, 13*b* are provided at the other sections of the pouch edge. Between the folding edge 12 and the opposite side seal 13*a*, the parallel running parting seal 7 is offset in the direction of the side seal 13*a* with the result that the first compartment 1 and the second compartment 3 have a different width in a direction transverse to the parting seal 7. Specifically, in the exemplary embodiment according to FIG. 1, a smaller volume is provided for accommodating the liquid 4 in the second compartment 3 than for the wipes 2 in the first compartment 1.

Figure 2:
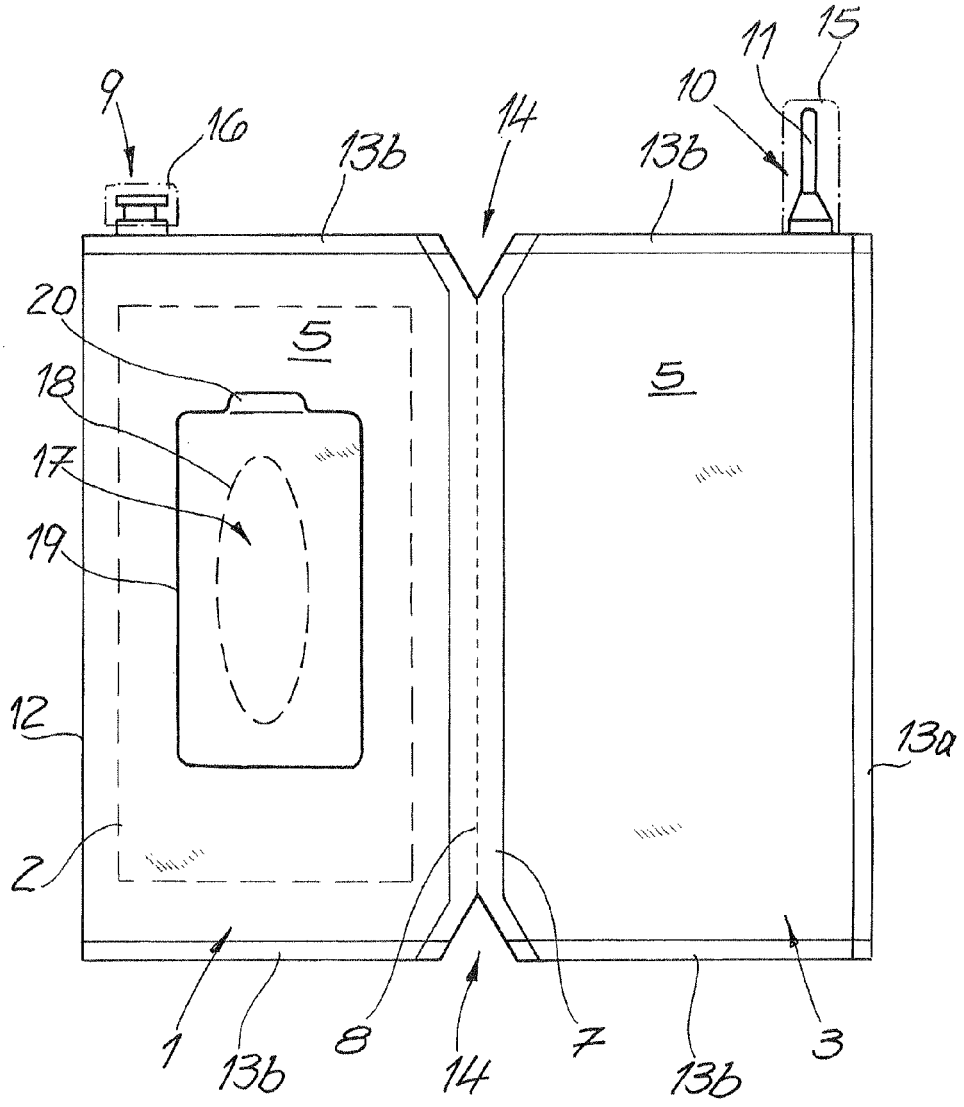
FIG. 2 shows an alternative embodiment of the dual compartment pouch in a plan view.

Naturally however, the two compartments 1, 3 also can enclose the same volume, as is shown as an example in FIG. 2, which otherwise corresponds to the embodiment according to FIG. 1.

In particular, it can be seen from FIG. 2 that the parting seal 7 connects mutually opposite side seals 13*b* where these side seals 13*b* each have a recess 14 at the ends of the parting seal 7. This recess 14, which also can be identified in FIG. 1, facilitates a tearing apart of the two compartments 1, 3.

In FIG. 2 it is further indicated that the two complementary fittings 9, 10 also can be provided with a breakable closure or a removable cover.

Thus, in FIG. 2 a removable protective cap 15 is indicated on the spout 11 of the second fitting 10 whereas the first fitting 9 is provided with a screw closure 16.

Additionally or alternatively, in particular, the first fitting 9 also can be provided with a check valve or the like, not shown in the figures, in order to avoid an escape of liquid 4 from the first compartment 1 after the supply of liquid 4 to the wipes 2.

It can be further identified in FIG. 1 that the first compartment 1 is provided with a withdrawal region on the front wall 5. For this purpose, a section 17 of the front wall is provided with an oval perforation line 18 and covered with a separate film slip 19 which is fastened with permanent adhesive on the front wall 5. Only a grip section 20 is not provided with permanent adhesive so that when lifting the film slip 19. By pulling on the grip section 20, the section 17 adhering to the film slip 19 by the permanent adhesive also is raised and as a result, the wipes 2 located thereunder are exposed. A renewed closure can then be made by again lowering and placing the film slip 19 flat.

The withdrawal device described is merely an example. Instead of a separable section 17, merely a slit can be provided. Furthermore, the withdrawal region also can be provided by a separate injection moulded part with a flap.

What is claimed is:

1. A dual compartment pouch for wipes and liquid, comprising:

a pouch body made of a pouch film, the pouch body having a front wall and a rear wall;

side seals which run on at least a portion of a circumferential pouch edge;

a parting seal connecting the front wall and the rear wall and separating a first compartment from a second compartment in a fluid-tight manner; and a first fitting on the first compartment and a second fitting on the second compartment;

wherein the first and the second fittings have a complementary shape to one another which after a separation of the compartments along the parting seal enables fluid communication of the first and the second fittings with one another; and wherein the first fitting is a female connecting member with an opening and the second fitting is a male connecting member with a spout that can be inserted into the opening.

2. The dual compartment pouch according to claim 1, wherein the first and the second fittings are sealed into a single associated section of a side seal.

3. The dual compartment pouch according to claim 1, wherein the first fitting is provided with a valve.

4. The dual compartment pouch according to claim 1, wherein the first fitting, the second fitting or both is provided with a breakable closure or a removable cover.

5. The dual compartment pouch according to claim 1, wherein the first compartment contains wipes and the second compartment contains a liquid.

6. The dual compartment pouch according to claim 1, wherein the first compartment has a tear-open withdrawal opening on the front wall or the rear wall.

7. The dual compartment pouch according to claim 1, wherein the parting seal connects two mutually opposite side seals, and wherein the two mutually opposite side seals each have a recess at the ends of the parting seal.

8. The dual compartment pouch according to claim 1, wherein the parting seal is provided with a weakening line.

9. The dual compartment pouch according to claim 1, wherein a section of the pouch edge running parallel to the parting seal is formed by a folding edge.

10. The dual compartment pouch according to claim 1, wherein the pouch film is multi-layer and has a heat-sealable inner layer.

11. The dual compartment pouch according to claim 1, wherein the first and the second compartments have different respective widths in a direction transverse to the parting seal.

* * * * *